US007262393B2

(12) United States Patent
Ishii et al.

(10) Patent No.: US 7,262,393 B2
(45) Date of Patent: Aug. 28, 2007

(54) RELEASABLY SEALABLE, AIR AND LIQUID IMPERMEABLE BAGS AND METHODS FOR LOW TEMPERATURE FOOD PREPARATION USING THE SAME

(75) Inventors: Tatsuya Ishii, Kobe (JP); Yuka Ishii, Kobe (JP); Satoru Hatano, Hyogo (JP); Ken Yoshikawa, Kobe (JP); Kumiko Shirai, Kobe (JP); John William Toussant, West Chester, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/292,234

(22) Filed: Nov. 12, 2002

(65) Prior Publication Data

US 2003/0057206 A1 Mar. 27, 2003

Related U.S. Application Data

(63) Continuation of application No. PCT/US00/12812, filed on May 11, 2000.

(51) Int. Cl.
*H05B 6/80* (2006.01)
*B65D 65/40* (2006.01)

(52) U.S. Cl. ..... 219/725; 219/731; 219/734; 426/234; 426/241

(58) Field of Classification Search ..... 219/725, 219/731, 734, 735; 426/106, 113, 114, 118, 426/127, 234, 241; 428/34.7, 35.7, 36.6; 383/42, 43, 210, 94, 95, 97, 98; 206/484
See application file for complete search history.

(56) References Cited

U.S. PATENT DOCUMENTS 3,716,369 A 2/1973 Perlman
4,355,721 A * 10/1982 Knott et al. ..... 206/524.2
4,785,937 A * 11/1988 Tamezawa et al. ..... 206/484
5,273,797 A 12/1993 Hazelton et al.
5,298,270 A 3/1994 Morgan
5,783,012 A 7/1998 Porchia et al.
6,455,084 B2 * 9/2002 Johns ..... 426/107

FOREIGN PATENT DOCUMENTS

DE 8715429 U 2/1988
FR 2769006 A 4/1999
WO WO97/25256 A 7/1997
WO WO98/50280 A 11/1998

OTHER PUBLICATIONS

PCT International Search Report for PCT/US00/12812; date of mailing Jun. 14, 2001.

* cited by examiner

*Primary Examiner*—Philip H. Leung
(74) *Attorney, Agent, or Firm*—David K. Mattheis; Stephen T. Murphy; Leonard W. Lewis

(57) ABSTRACT

Disclosed is a releasably sealable bag for low temperature cooking comprising a film material, wherein the film material does not deform at temperatures of up to about 125° C., and wherein the bag is air and liquid impermeable when sealed. Also disclosed are such bags wherein at least a portion of the film material is comprised of a composite film material provided with a pressure sensitive adhesive protected from inadvertent adherence. Further disclosed are methods for food preparation and cooking using any of the embodiments of the bag of the present invention.

4 Claims, 6 Drawing Sheets

RELEASABLY SEALABLE, AIR AND LIQUID IMPERMEABLE BAGS AND METHODS FOR LOW TEMPERATURE FOOD PREPARATION USING THE SAME

CROSS-REFERENCE

This application is a continuation of International Application PCT/US00/12812 with an international filing date of May 11, 2000.

FIELD

The present invention relates to a releasably sealable bag and to methods for low temperature food preparation, especially low temperature cooking, using such a bag. More specifically, it relates to a releasably sealable bag that is air and liquid impermeable when sealed, and that does not deform at temperatures of up to about 125° C., and to methods of low temperature cooking and food preparation using the same.

BACKGROUND

Low temperature vacuum cooking is a method of cooking at temperatures of about 100° C. of less. This cooking method can be used to provide better flavor as compared to certain other cooking methods, as well as to provide aesthetically pleasing, nutritious foods. However, at present such cooking requires complex and expensive equipment that is normally used only by professional chefs.

It is also known to re-heat various prepared foods using flexible bags or pouches called retortable bags. For example, certain prepared foods that are suitable to be eaten after re-heating can be purchased in hermetically sealed plastic bags. The sealed bag is placed in boiling water, and the heat from the boiling water re-heats the food without penetrating the bag. The user then only has to cut open the bag and remove the contents. A common example of this type of product is curry, available for example from the House Shokuhin, S&B Shokuhin, and Ajinomoto Companies of Japan.

The types of retortable foods that can packaged and re-heated in this manner are quite limited. In addition, such retortable bags cannot be used to actually cook fresh foods; they can only be used to re-heat a particular food that has already been prepared and preserved. Accordingly, such bags must be provided with some type of preservation agent, e.g., aluminum, as the freshness of the stored food product during storage and shelf life prior to consumer purchase must be maintained.

In addition, conventional food storage bags, such as those available under the brand name ZIPLOC from the S. C. Johnson Company in the United States and from the Asahi Kasei Company in Japan, and UBE Kitchen Bag from the UBE Film Company of Onoda City, Yamaguchi Prefecture, Japan, are difficult if not impossible to use for re-heating or for cooking foods in hot or boiling water. The materials (generally polyethylenes or blends thereof) from which these bags are made may not be capable of providing air tightness and/or liquid-tightness when sealed or during re-heating or cooking; similarly, such materials may not be heat resistant and may deform at temperatures of 100° C. Even if it is assumed that such material itself is air and liquid tight, practical methods for sealing/re-sealing of such bags and for a variety of food preparation techniques are extremely limited.

Self-venting bags comprised of nylon and polypropylene that can be used for cooking of certain foods (such as potatoes) by placing the bag in boiling water have been sold under the name "Jokigen" by the Jomei Company of Japan. However, this type of bag must be heat sealed by using a particular device before it can be placed in the water, and once sealed, it cannot be re-sealed.

There also exists a need to improve the meal preparation chores of consumers. Meal preparation and dish cleaning are believed to account for about 50% of today's household chores, and many consumers wish to reduce the time spent on meal preparation and clean-up. Although home meal replacement, take-out, and deli-style foods are available, such foods may not provide adequate nutrition and in general are perceived as unhealthy substitutes for home-cooked meals by many consumers. Some consumers further experience a sense of guilt when they substitute such alternatives for home-cooked meals. Thus, more efficient meal preparation without trade-offs relating to nutritive value, cost, taste, and pride in food preparation are desired by many consumers.

Therefore, it can be seen that there remains a desire to provide a convenient and durable bag that can be used for low temperature preparation and cooking of fresh foods in the home, without the use of expensive equipment or complicated procedures, that can make meal preparation more efficient without sacrificing taste, nutrition, and pride in food preparation. None of the existing art provides all of the advantages and benefits of the present invention.

SUMMARY

The present invention relates to a releasably sealable bag for low temperature cooking comprising a film material, wherein the film material does not deform at temperatures of up to about 125° C., and wherein the bag is air and liquid impermeable when sealed.

The present invention further relates to such bags wherein at least a portion of the film material is comprised of a composite film material provided with a pressure sensitive adhesive protected from inadvertent adherence.

The present invention additionally relates to methods for low temperature cooking, microwave cooking, and preparation of marinated foods using any of the embodiments of the bag of the present invention.

These and other features, aspects, and advantages of the invention will become evident to those skilled in the art from a reading of the present disclosure.

BRIEF DESCRIPTION OF THE DRAWINGS

While the specification concludes with claims particularly pointing out and distinctly claiming the invention, it is believed that the present invention will be better understood from the following description of preferred embodiments taken in conjunction with the accompanying drawings in which:

DETAILED DESCRIPTION

All cited references are incorporated herein by reference in their entireties. Citation of any reference is not an admission regarding any determination as to its availability as prior art to the claimed invention.

Herein, "comprising" means that other steps and other components which do not affect the end result can be added. This term encompasses the terms "consisting of" and "consisting essentially of."

According to the present invention, a bag into which food items to be prepared, preferably cooked, is provided. In general, the bag must: (1) provide an air and liquid impermeable seal during the food preparation time; and (2) provide heat resistance at temperatures of up to at least about 100° C., i.e., during cooking by boiling in water, and preferably at temperatures of up to at least about 125° C., i.e., during heating in a microwave oven, such that the bag does not deform and such that its structural integrity is not otherwise compromised at such temperatures. It is further desirable that the bag be made from material that does not impart malodor to food during preparation or cooking.

Accordingly, any type of material that possesses these properties may be used herein. Preferred embodiments of the bag of the present invention comprise a composite film material, as described in detail below.

Figure 1A:
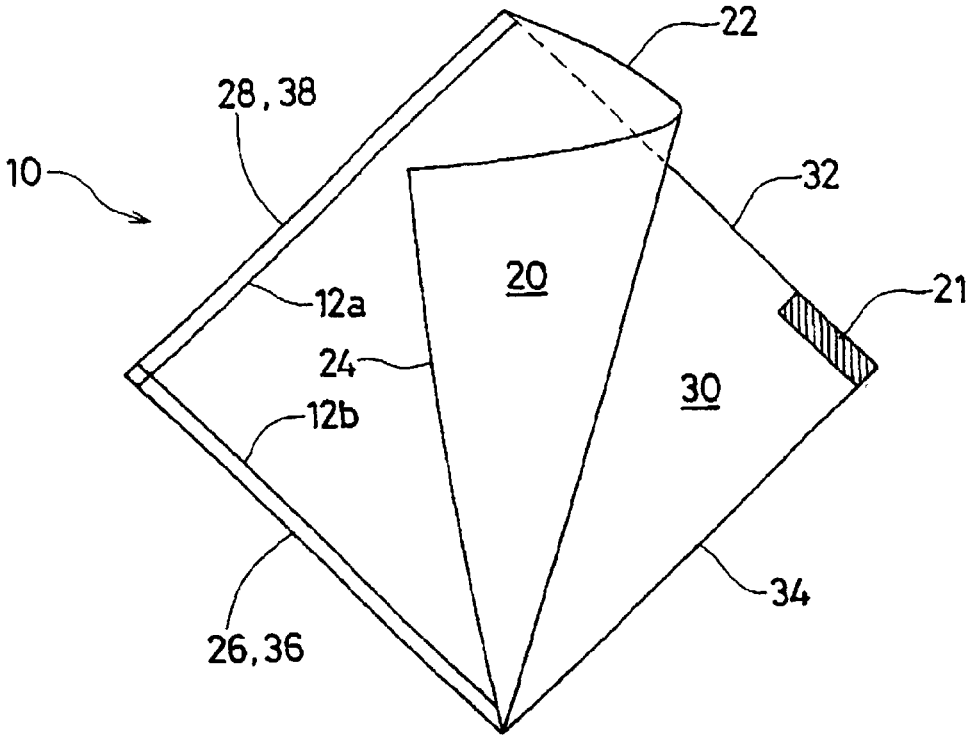
FIGS. 1*a-c* are perspective views of preferred embodiments of the bag of the present invention.
Figure 1B:
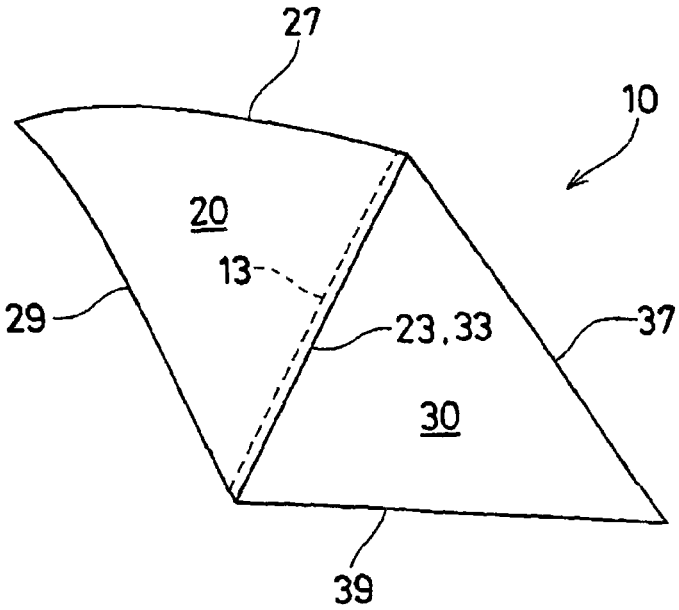
Figure 1C:
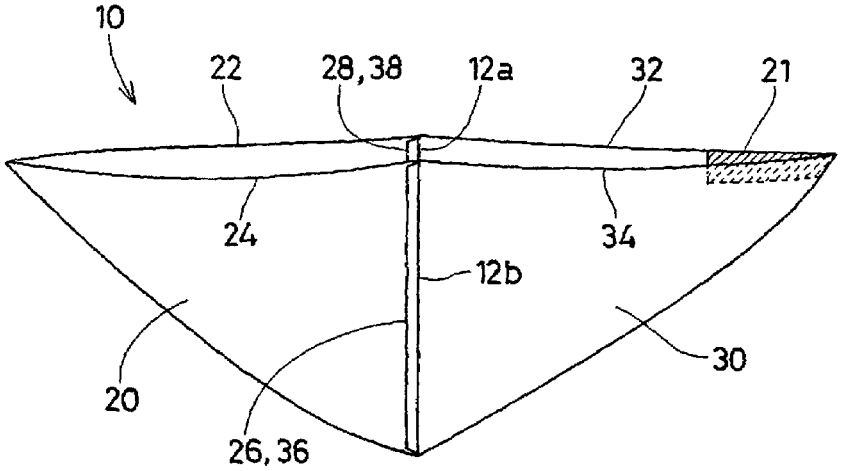

One preferred embodiment of the bag of the present invention is comprised of at least two superimposed sheets of film material having at least a portion of their superimposed edges being permanently sealed. For example, in the embodiment of the bag 10 that is shown in FIGS. 1*a*-1*c*, superimposed sheets of film material 20 and 30 are permanently sealed along at least one of their superimposed edges. For example, first sheet 20 has edges 22, 24, 26, 28. Second sheet 30 has edges 32, 34, 36, and 38. In this embodiment, at least one pair of the superimposed edges is permanently sealed, e.g., edge 22 to edge 32, edge 24 to edge 34, edge 26 to edge 36, or edge 28 to edge 38 in the embodiment of FIG. 1*a;* in the embodiment of FIG. 1*c,* edge 23 to edge 33, edge 27 to edge 37, or edge 29 to edge 39, may be permanently sealed. For example, the permanent seal may be formed as indicated by the reference numerals 12*a* and 12*b* in FIGS. 1*a* and 1*c* and reference numeral 13 in FIG. 1*b*.

It should be understood that the permanently sealed portion of the edges need not extend for the entire length of the superimposed edges, as it does in the preferred embodiment shown in FIG. 1. The permanent seal may be provided at any portion and for any desired length of the superimposed edges.

As used herein, "permanently sealed" means that these edges are not intended to be opened by the consumer during use of the bag 10; they are not releasably sealable. Any method known to those of skill in the art, e.g., heat sealing, can be use to create the permanently sealed portion of the superimposed edges of the bags herein.

If the bag is of a square or rectangular shape, as shown in FIG. 1*a,* it may be desirable for two of the superimposed edges to be permanently sealed, e.g. edge 26 of first sheet 20 is permanently sealed to edge 36 of second sheet 30 along the permanent seal 12*a;* and edge 28 of first sheet 20 is permanently sealed to edge 38 of second sheet 30 along the permanent seal 12*a.* FIG. 1*c* shows the bag of FIG. 1*a* in its fully opened position, the advantages of which are described in fuller detail below.

Referring again to FIG. 1*a,* in a preferred embodiment having two permanently sealed edges, the two permanently sealed edges are preferably adjacent, e.g., two of the intersecting edges of a rectangular or square shaped bag that are perpendicular to each other, e.g. edges 26, 36 and 28, 38. However, two opposing, non-intersecting edges such as 22, 32 and 26, 36; or 24, 34 and 28, 38 may be selected as the permanently sealed edges.

FIG. 1*b* shows an alternative embodiment in which the bag 10 is provided in a triangular shape, with one pair of superimposed edges 23, 33 being permanently sealed along permanent seal 13. Again, it should be understood that the permanently sealed portion of the edges need not extend for the entire length of the superimposed edges, and may be provided at any portion and for any desired length of the superimposed edges.

It should also be understood that the present invention is not limited to any particular shape or configuration for the bag 10 or for the sheets 20, 30. In addition, it is not necessary that the sheets be of identical or similar size, or of identical shape. Furthermore, the preferred embodiments herein are not limited to bags comprised of one sheet or two sheets of film material. Bags comprised of more than two sheets are also within the scope of the present invention.

Figure 2A:
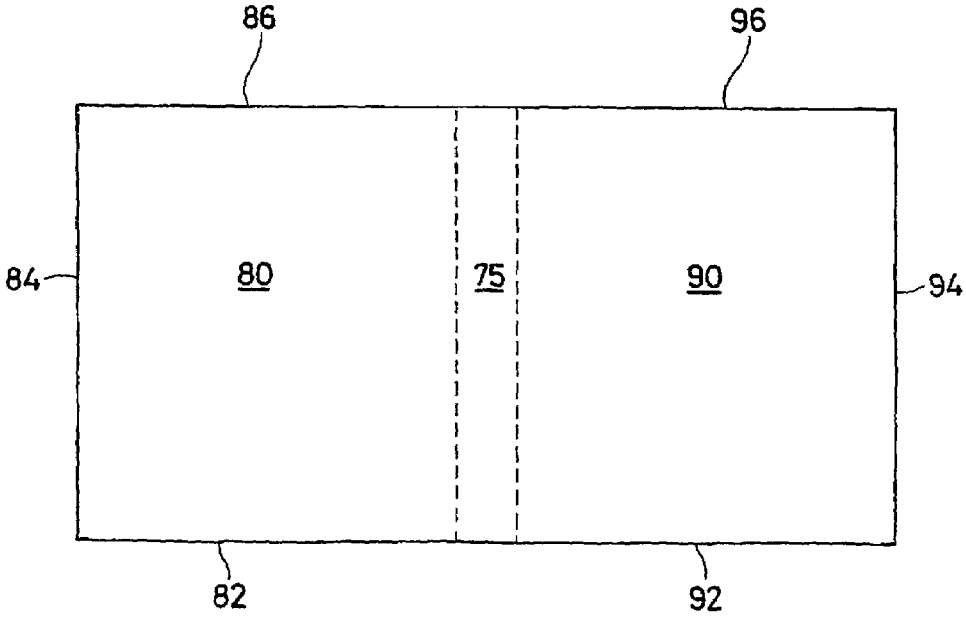
FIG. 2*a* is a plan view of a sheet of composite film material prior to formation into the preferred embodiment of a bag of the present invention shown in FIG. 2*b;*

Referring again to FIGS. 1*a*-*c,* at least one of the sheets 20, 30 is a composite film provided with a pressure sensitive adhesive protected from inadvertent adherence. By the phrase "inadvertent adherence" it is meant that the adhesive bearing sheet does not prematurely stick to a target surface, e.g., to the other sheet, to another portion of the same sheet, or to any other surface, until the user of the bag activates the adhesive by pressing the sheet. The adhesive-bearing film sheet is releasably sealable to the other film sheet, or to another portion of itself, when pressed thereagainst, to create a seal perimeter (not shown in FIG. 1, see, e.g., FIG. 2*c*). The composite film material itself will be described in greater detail below.

Thus, the seal perimeter will be created at the location chosen by the consumer when the consumer presses the sheet. Any location can be chosen and it should be noted that the seal perimeter need not coincide with the edges of the sheet material.

Figure 2B:
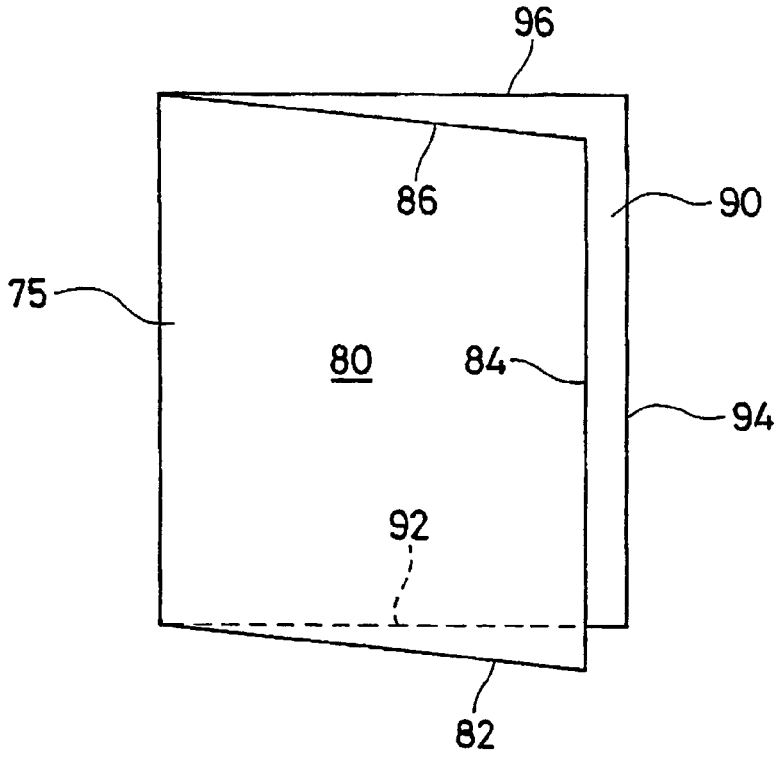
FIG. 2*b* is a perspective view of the bag formed from the sheet shown in FIG. 2*a;*
Figure 2C:
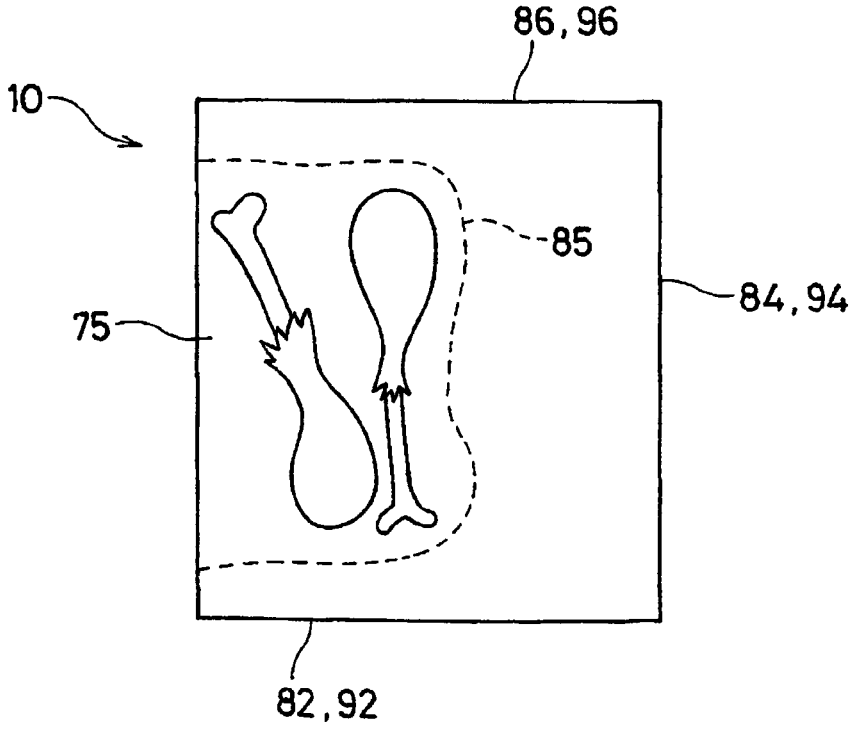
FIG. 2*c* is a plan view of the bag shown in FIGS. 2*a* and 2*b* with a food item placed in an interior of the bag.

If the sheet 70 is of square or rectangular shape, the releasably sealable portion of the seal perimeter may be created at or approximately at the juxtaposed free edges (e.g., 82 and 92, 84 and 94, and 86 and 96, as shown in FIG. 2*b*) to give the largest interior area for the bag. However, as noted above, the seal perimeter may be formed at any desired location.

The bag 10 may additionally be provided with an opening indication means 21 to facilitate opening of the sheets prior to inserting an item to be stored or cooked. The opening indication means 21 may equally well facilitate re-opening of the bag when it is desired to remove items from the bag after the bag has been sealed. Opening indication means 21 may be separate from sheets 20, 30, e.g., a tab made from material different from that of either of both of the sheets 20, 30. Or, opening indication means 21 may be integral with either or both of sheets 20, 30, e.g., it may be made from a color or printing indication in the film that signals an appropriate opening location to the user. Preferably, the opening indication means visually contrasts with the other surface that it contacts.

Another preferred embodiment of the bag of the present invention (not shown in the Figures) is similar to that shown in FIGS. 1*a-c;* however, in such a preferred embodiment, there are no permanently sealed edges or portions of permanently sealed edges. In such a preferred embodiment, at least one of the film sheets is a composite film material as described below, and the adhesive-bearing sheet is releasably sealable to the other film sheet when pressed thereagainst to create a seal perimeter that forms an interior of the bag.

Yet another preferred embodiment of the bag of the present invention is shown in FIGS. 2*a-b.* In this embodiment, the bag 10 is comprised of a single sheet 70 as described in detail below. The sheet 70 has a first portion 80, a second portion 90, and a juncture area 75 located generally between the first and second portions 80, 90. The juncture area 75 is shown in dashed lines in FIG. 2*a* to indicate that it does not have an exactly defined area or location. In addition, it can divide the first portion 80 and the second portion 90 into areas of any respective sizes or shapes; these portions need not necessarily be of equal or approximately equal size or shape.

It should be noted that the rectangular shaped sheet 70 that is shown in FIG. 2*a* is not intended to be a limiting shape. Like the preferred embodiment shown in FIG. 1, any shape for the sheet 70 is within the scope of the present invention, e.g., circular, oval, triangular, amorphous, decorative.

The first portion is bounded by at least one first portion free edge. In the embodiment shown in FIG. 2*a,* the first portion free edges are indicated by the reference numerals 82, 84, and 86. The second portion is bounded by at least one second portion free edge. The second portion free edges are indicated by the reference numerals 92, 94, and 96. Again, it should be noted that this embodiment is not limited to having a specified number of free edges. For example, if the sheet 70 were oval, there would be one continuous first portion free edge that would not be shown in three segments as shown in FIG. 2*a.*

In one preferred embodiment, at least one of the first portion 80 or the second portion 90 is comprised of a composite material provided with a pressure sensitive adhesive protected from inadvertent adherence. In another preferred embodiment, both of the first portion 80 and the second portion 90 is comprised of a composite material provided with a pressure sensitive adhesive protected from inadvertent adherence. In yet another preferred embodiment, the juncture area 75 is further comprised of a composite material provided with a pressure sensitive adhesive protected from inadvertent adherence.

In another, more preferred embodiment, the sheet is a unitary sheet of a composite material provided with a pressure sensitive adhesive protected from inadvertent adherence; in other words, the first portion 80, the second portion 90, and the juncture area 75 exist as locations on the same unitary sheet from which the bag is formed.

The bag 10 is formed from the sheet 70 as follows, see FIG. 2*b.* First portion 80 is folded generally at or around the juncture area 75 so that it is overlaid onto the second portion 90. A seal perimeter 85 may be created by pressing one of the first or second portions against the other portion at a desired location. Thus, an interior of the bag 10 is formed within the seal perimeter 85. The seal perimeter may be created totally independent of the juncture area 75 if desired by the consumer. Or, the interior may be further be comprised within the juncture area as well as within the seal perimeter 85 as shown on FIG. 2*c.*

In another preferred embodiment of a bag of the type shown in FIG. 2, it is desirable to provide at least one of the first or second portion free edges with an opening indication means, as described hereinbefore and in a manner similar to that shown in FIG. 1*a.* Preferably, such an opening indication means visually contrasts with the other first or second portion free edges that are not provided with the opening indication means.

In each of the above-described embodiments, at least one of the sheets 20 or 30, or the sheet 70, in the embodiments described in connection with FIG. 1, or at least one of the first portion 80 or the second portion 90 in the embodiments described in connection with FIG. 2, is comprised of a composite material such as that described in Hamilton et al. U.S. Pat. No. 5,662,758, "Composite Material Releasably Sealable to A Target Surface When Pressed Thereagainst and Method of Making," issued on Sep. 2, 1997; Hamilton et al. U.S. Pat. No. 5,871,607, "Material Having A Substance Protected By Deformable Standoffs And Method of Making," issued on Feb. 16, 1999; McGuire et al. U.S. Pat. No. 5,965,235, "Three-Dimensional, Amorphous-Patterned, Nesting-Resistant Sheet Materials and Method and Apparatus for Making Same," issued Oct. 12, 1999; and Hamilton et al. U.S. Pat. No. 5,968,633, "Selectively-Activatible Sheet Material For Dispensing And Dispersing a Substance Onto A Target Surface," issued on Oct. 19, 1999.

Such a composite material is a flexible film coated with a pressure sensitive adhesive for releasably sealing to a target surface and for preventing premature sticking to a target surface. More particularly, the composite material is a flexible film that has protrusions formed on an adhesive side which act to space a pressure sensitive adhesive from a target surface until the film is pressed thereagainst. According to the present invention, the "target surface"herein is the other of the film sheets 20 or 30 in the embodiments shown in FIG. 1, or another portion of the same sheet 70 as shown in the FIG. 2 embodiments.

Figure 3:
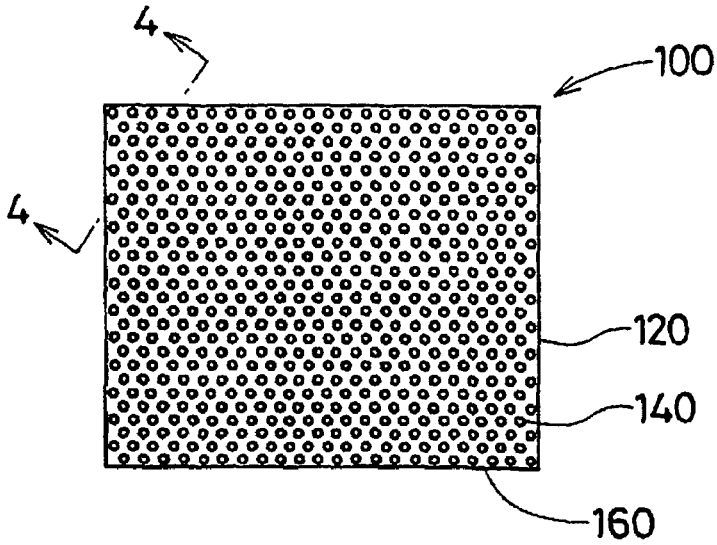
FIG. 3 is a top plan view of a preferred embodiment of the composite material of the present invention, showing a piece of flexible film having thermoformed truncated conical protrusions between a grid of pressure sensitive adhesive.

Although a full disclosure of the composite materials herein is given in the above-referenced patents, a concise description will be repeated herein. One embodiment of the composite film is shown in FIG. 3 and is generally indicated as 100. The composite film 100 generally includes a piece of flexible film 120 having protrusions 140 and a layer of pressure sensitive adhesive 160 located between protrusions 140. In the embodiment of the film 100 that is shown in FIG. 3, the protrusions 140 are conical in shape with truncated or domed outermost ends 180. The protrusions 140 are equally spaced in an equilateral triangular pattern, all facing the same direction. They are spaced center to center a distance approximately two protrusion diameters. Protrusions 140 have heights which are preferably less than their diameters, so that when they collapse, they collapse along an axis which is substantially perpendicular to a plane of film 120.

This mode of collapse avoids protrusions 140 folding over and blocking adhesive from contact with a target surface.

Figure 4:
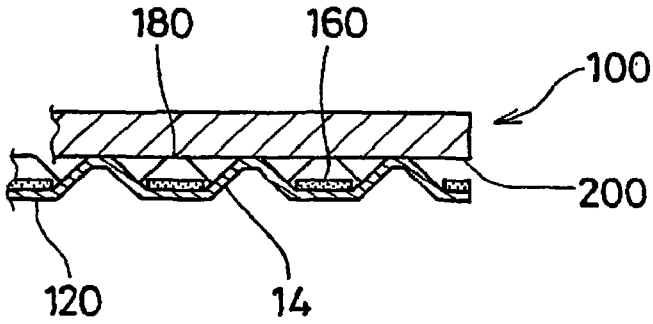
FIG. 4 is a sectioned elevation view of the composite material of FIG. 3, taken along section line 4-4 of FIG. 3, showing the protrusions acting as stand-offs from an adhesive layer between protrusions, such that a target surface contacting the outermost ends of the protrusions does not contact the adhesive layer.
Figure 5:
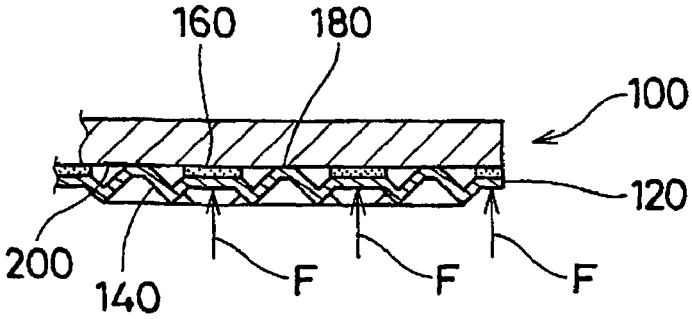
FIG. 5 is a sectioned elevation view thereof, similar to FIG. 4, showing the effect of pressing the dimpled composite material against the target surface, such that protrusions collapse and allow the adhesive layer between protrusions to contact the target surface.

FIG. 4 shows a target surface 200, which according to the present invention is either another film sheet that comprises the bag 10 or another portion of the same film sheet from which the bag is formed, being spaced away from the layer of pressure sensitive adhesive 160 by outermost ends 180 of protrusions 140. FIG. 5 shows the target surface 200 contacting a layer of pressure sensitive adhesive 160 after protrusions 140 have partially inverted on themselves under pressure applied to the non-adhesive side of flexible film 120, as indicated by force F.

In the embodiment of the film 100 that is shown in FIGS. 3-5, the conical protrusions 140 have a base diameter of about 0.015 inches (0.381 mm) to about 0.03 inches (0.762 mm). They also have a center to center spacing of from about 0.03 inches (0.762 mm) to about 0.06 inches (1.524 mm), and a protrusion height of about 0.004 inches (0.102 mm) to about 0.012 inches (0.305 mm). The film material may be made from homogenous resins or blends thereof. Single or multiple layers within the film structure are contemplated whether co-extruded, extrusion-coated, laminate or combined by other known means. The key attribute of the film material is that it be formable to product protrusions and valleys. Useful resins include polyethylene, polypropylene, PET, PVC, PVDC, latex structures, nylon, etc. The preferred film material is from about 0.01 to about 0.02 mm, more preferably from about 0.012 to about 0.015 mm, nominal thickness polyethylene. A preferred film material is 100% HDPE film, about 0.012 mm, available from the Tredegar Co., USA. Such films are also available from the Exxon Co., USA.

A preferred adhesive herein is a hot melt pressure sensitive adhesive about 0.025 mm thick. Such hot melt adhesives, for example those available from the Findley Co., USA, e.g., specification nos. ATO Findley 2630.07, 2630.08, and 2630.09, and those available from the H.B. Fuller Co. of Minnesota, USA, e.g., specification nos. HB Fuller HL-2115X, HB Fuller HL 1711-XZP, and HB Fuller HL 1717-X, are suitable for use herein. Alternatively, other adhesives including latex can also be used for the adhesive layer 160.

The size and spacing of protrusions is optimized to provide a continuous adhesive path for fluid tight seals, but without generating a film that is easily stretched. Stretched film result in residual forces parallel to the plane of adhesive contact, which may cause the weak adhesive bond to break.

Even more preferably, the composite sheet herein is a three-dimensional composite sheet material that resists nesting of superimposed layers into one another as described in the aforementioned McGuire et al. U.S. Pat. No. 5,965,235. To provide such nesting resistant advantages, the protrusions form an amorphous pattern of a plurality of different two-dimensional geometrical shapes on one side of the composite sheet material; on the opposite side are provided a plurality of spaced, three-dimensional hollow depressions corresponding to the protrusions, such that the protrusions are hollow. The term "amorphous" as used herein is generally in accordance with the ordinary meaning of the term, i.e., a pattern which exhibits no readily perceptible organization, regularity, or orientation of constituent elements. In such a pattern, the orientation and arrangement of one element with regard to a neighboring element bear no predictable relationship to that of the next succeeding element(s) beyond.

Figure 6:
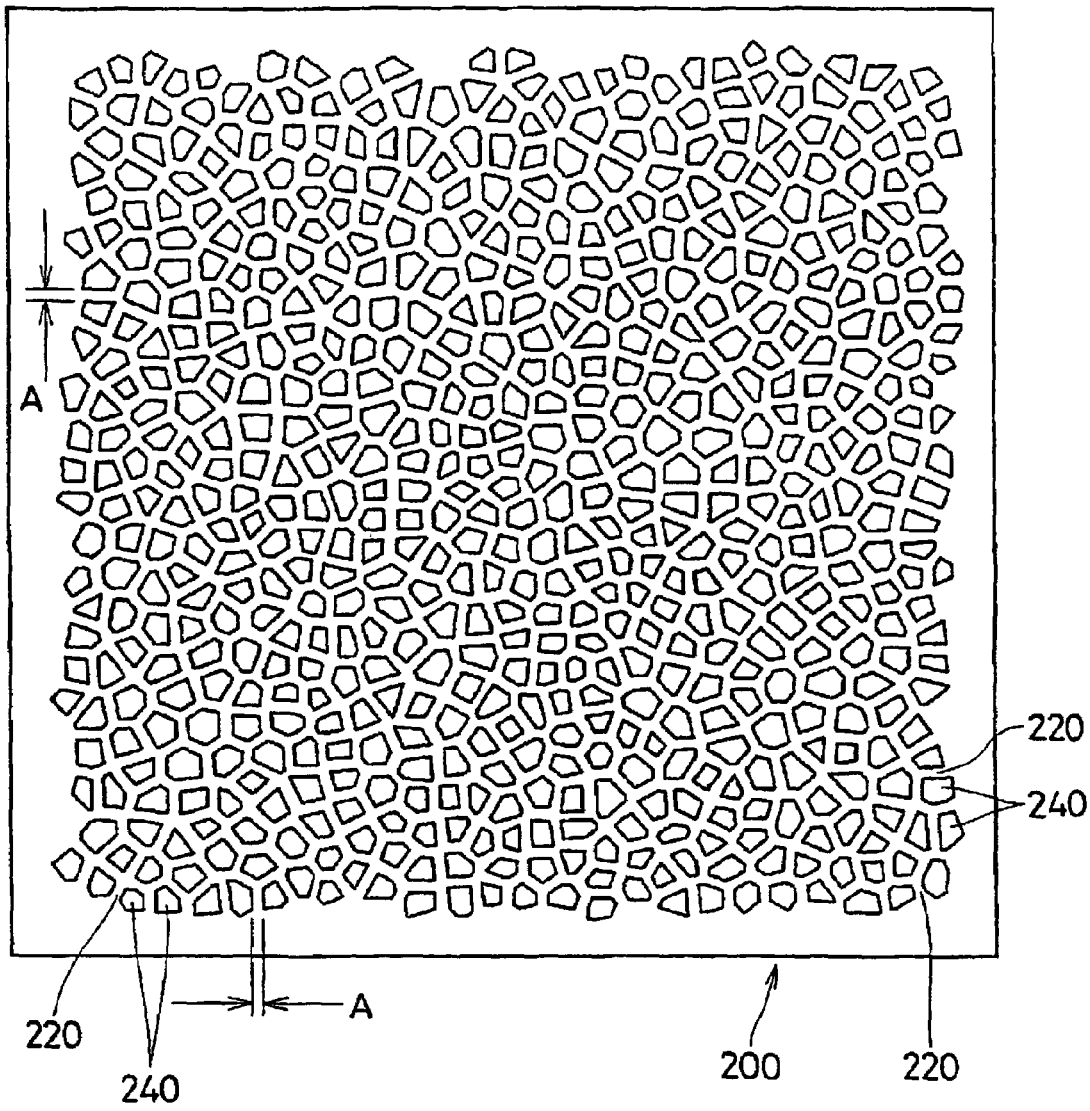
FIG. 6 is a plan view of another preferred embodiment of a three-dimensional, nesting resistant composite sheet material according to the present invention.

Within the preferred amorphous pattern, protrusions will preferably be non-uniform with regard to their size, shape, orientation with respect to the web, and spacing between adjacent protrusion centers. FIG. 6 is a plan view of a representative three-dimensional, nesting-resistant sheet material 200 in accordance with the present invention. The protrusions are indicated by the reference numeral 240 and the spaces by reference numeral 220. Also indicated on FIG. 6 is the dimension A, which represents the width of spaces 220, measured as the substantially perpendicular distance between adjacent substantially parallel walls at the base of the protrusions. In a preferred embodiment, the width of the spaces 220 is preferably substantially constant throughout the pattern of protrusions.

Protrusions 240 are generated with non-uniform size and shape so that one sheet or piece of the material 200 may be placed in face to face contact with another sheet or piece of material 200 without nesting occurring between the two sheets. The nesting-resistant feature is achieved because the amorphous pattern of the protrusions as discussed above limits the ability of the face of one sheet to align with the back of another sheet whereby the protrusions of one layer enter the depressions formed behind each protrusion in an adjacent layer. The benefit of narrow constant width spaces between protrusions is that protrusions cannot also enter spaces 220 when layers of material 200 are placed face to face.

The use of polygons having a finite number of sides in the amorphous pattern arranged in an interlocking relationship provides an advantage over structures employing circular or near circular shapes. Patterns such as arrays of circles are limited in terms of the amount of area the circles can occupy relative to the non-circled area between adjacent circles. More specifically, even in a pattern where adjacent circles touch at their point of tangency there will still be a given amount of space "trapped" at the "corners" between consecutive tangency. Accordingly, even amorphous patterns of circular shapes are limited in terms of how little non-circle area can be designed into the structure. Conversely, interlocking polygonal shapes with finite numbers of sides (i.e., no curvilinear sides) can be designed so as to pack closely together and in the limiting sense can be packed such that adjacent sides of adjacent polygons can be in contact along their entire length such that there is no "trapped" free space between corners, see FIG. 6. Preferably, the amorphous pattern herein has a statistically controlled degree of randomness, as described in detail in U.S. Pat. No. 5,965,235.

The three-dimensional shape of the individual protrusions is believed to play a role in determining both the physical properties of individual protrusions as well as overall web properties. The use of an interlocking polygonal base pattern for the protrusions is believed to be highly advantageous herein. Such a polygonal pattern is preferably comprised of interlocking convex polygons each having a finite number of substantially linear sides with facing sides of adjacent polygons being substantially parallel. However, it should be understood that the protrusions may be formed from virtually any three dimensional shape.

Protrusions 240 are preferably spaced center to center an average distance of approximately two protrusion base diameters or closer, in order to minimize the volume of valleys between protrusions and hence the amount of adhesive located between them. Preferably, the protrusions have heights that are less than their diameters, so that when they deform, they deform by substantially inverting and/or crushing along an axis that is substantially perpendicular to a plane of the material. This protrusion shape and mode of deforming discourages protrusions from folding over in a direction parallel to a plane of the material so that the protrusions cannot block the adhesive in the valley between them from contact with a target surface.

A preferred adhesive herein is a hot melt pressure sensitive adhesive about 0.025 mm thick. Such hot melt adhesives, for example those available from the Findley Co., USA, e.g., specification nos. ATO Findley 2630.07, 2630.08, and 2630.09, and those available from the H.B. Fuller Co. of Minnesota, USA, e.g., specification nos. HB Fuller HL-2115X, HB Fuller HL 1711-XZP, and HB Fuller HL 1717-X, are suitable for use herein. Alternatively, other adhesives including latex can also be used for the adhesive layer 160.

The film material may be made from homogenous resins or blends thereof. Single or multiple layers within the film structure are contemplated, whether co-extruded, extrusion-coated, laminated or combined by other known means. The key attribute of the film material is that it be formable to produce protrusions and valleys. Useful resins herein include polyethylene, polypropylene, PET, PVC, PVDC, latex structures, nylon, etc. Preferred material gauges are about 0.0025 mm to about 0.25 mm. A preferred film material is 100% HDPE film, about 0.012 mm, available from the Tredegar Co., USA. Such films are also available from the Exxon Co., USA. Forming may be done by mechanical embossing, vacuum thermoforming, hydroforming, or combinations thereof, as well as by other forming methods known to those of skill in the art.

It should be noted that while the entire surface of a sheet preferably exhibits such an amorphous pattern, under some circumstances it may be desirable for less than the entire surface of such a sheet to exhibit such a pattern. For example, a portion of the sheet may exhibit some regular pattern of protrusions or may in fact be free of protrusions so as to present a generally planar surface.

In addition, the designer may separate the amorphous regions with a regular, non-amorphous pattern or a "blank" region with no protrusions at all, or any combination thereof. The shape and dimensions of the non-amorphous regions can further be customized.

As noted previously, in the embodiment shown in FIG. 1, at least one of the sheets 20 or 30 comprising the bag 10, or a portion of the sheet for embodiments made from a single sheet, is a composite sheet material as described above. The other sheet material or portion thereof of may be the same or a similar composite material; or, the other sheet or portion thereof may be a non-composite sheet material, which may be any conventional film material known to those of skill in the art, e.g., high density polyethylene or low density polyethylene. In the embodiment shown in FIG. 2, at least a portion of the sheet 70 forming the bag 10 is a composite sheet material as described above. As a result, a user of the bag 10 can releasably seal the bag as desired by simply pressing at any other desired location to activate the adhesive of the composite sheet to tightly seal it at a seal perimeter to a target sheet or target portion.

It may also be desirable to provide the sheet materials herein or any portion or portions thereof some type of decorative printing for aesthetic appeal. Such printing may be done in any pattern, color, style, design, etc.

FIG. 1*c* shows the bag of FIG. 1*a* in its fully opened state, illustrating one of the advantages of the present invention. As shown in FIG. 1*c*, the bag 10 is provided with a large insertion and removal area that exists as a result of the fact that the bag has two superimposed edges that are not permanently sealed. For example, representative dimensions for a bag according to the present invention are about 29.2-30.0 cm by about 30.0 cm. For a bag such dimensions, the insertion/removal open area is about 1040 $cm^2$, calculated by defining the open area as a complete circle.

Other non-limiting dimensions generally convenient for household use include about 15.0 cm by about 15.0 cm, and about 60.0 cm by about 60.0 cm.

In contrast, conventional bags having only one side usable for insertion and removal, e.g., zipper-type bags or stock bags, cannot provide such advantages. In the commercially available zipper-type bags, the opening may actually be narrower than the actual bag dimensions due to the area necessary for incorporation of the zipper materials and closure. Such zipper-type bags can therefore be inconvenient or impossible to use for large or irregularly shaped items. For example, a commercially available ZIPLOC vegetable storage bag, Large Size, has dimensions of about 26.8 cm by 27.9 cm. Yet its insertion/removal open area is only about 223 $cm^2$, calculated by defining the open area as a complete circle.

Therefore, it can be seen the open area mouth size of the embodiment of the bag shown in FIGS. 1*a* and 1*c* of the present invention, when in its fully opened state, is at least about 50% greater than that of other commercially available storage bags; e.g., stock bags and zipper bags.

While it will be appreciated that a square or rectangular shape gives a large interior area available for use and may provide two non-permanently sealed edges for convenient insertion and removal, other shapes can be provided and are within the scope of the present invention, for example an oval or circular bag comprised of at least one sheet of the composite material described here, with a releasably sealable open area for insertion and removal of food items.

In addition, bags having no permanently sealed edges are equally and sometimes more convenient to use than those having permanently sealed edges. The type of bag that is most suitable for the intended use depends on the desired use, the size and shape of the item to be placed in the interior of the bag, and the preference of the user.

Therefore, it can be seen that the insertion and removal of food items to be cooked into and out of the preferred embodiments of the bags 10 of the present invention can be accomplished with ease, as the bag can accommodate many different sizes and shapes of food items.

In addition to the composite material described above, other preferred embodiments include bags made from plastic films such as polyethylene, nylon, polypropylene, polyvinyledenchloride, polymethylpenten, water proof paper, water proof non-woven materials, and mixtures thereof.

If the bag is formed from one of the above-listed materials, i.e., if it is formed from other than a composite film material having a pressure sensitive adhesive protected from inadvertent adherence, the releasable seal may be created by means known to those of skill in the art provided that the seal is air and liquid impermeable.

In addition, since the cooking usages herein are not merely a reheating process for retortable foods, it is not necessary to incorporate a food preservation agent, such as aluminum, into the film material that comprises the bag. Preferably, the bags of the present invention are free from food preservation agents.

The bags of the present invention provide many advantages over currently available methods of meal preparation. Efficiency of meal preparation is improved, for example, in the following ways. Foods can be pre-packed and stored in the refrigerator; then the pre-packed foods can be prepared when desired simply by placing in boiling water. Also, after the bag has been placed in the boiling water, there is no need to remain in the kitchen for the entire boiling time, freeing up time to do other things during meal preparation.

It is also believed that anyone can conveniently use the bags of the present invention to prepare fresh meals, as there is no need to learn any special skills for cooking. In addition, there is virtually no risk of burning the food being cooked according to the present invention since the food is heated to a maximum of about 100° C. during boiling. This temperature is much lower than the burning points of most foods.

Also important are the nutrition benefits believed to be provided by the bags of the present invention. According to the *New Food Ingredient Tables* published by the Hitotsubashi University, Tokyo, Japan (*Shin Shokuhin Seibun Hyou,* Hitotsubashi Shuppan, Inc., 1998) 90% of vitamin $B_2$ is retained in vegetables that are steam cooked. In comparison, only 70-80% of vitamin $B_2$ is retained in vegetables that are cooked by conventional boiling methods, i.e., placing the vegetables directly into boiling water as is. Similarly, 80% of vitamin C is retained in vegetables that are steam cooked, whereas only 50-60% of vitamin C is retained after conventional boiling preparation. The low temperature cooking methods comprising placing a bag according to the present invention into boiling water as described herein are methods for steam cooking. It is therefore believed that cooking with the bags according to the present invention will provide nutrition benefits similar to those detailed in the reference described herein.

The appearance of the fresh colors of vegetables is also easily maintained by cooking according to the present invention. This is believed to be a result of the limited loss of chlorophyll associated with the low cooking temperatures.

It is also believed that taste, texture, and overall aesthetic benefits are provided by the bags of the present invention. For example, the soft/tender textures and the juiciness of meats and fishes prepared according to the present invention can be maintained because the food is not heated to high temperatures. In addition, fish cooked according to the present invention can be expected to have a pleasing appearance in that the skin does not detach from the fish meat during cooking. Conventional cooking methods frequently cause the skin of fish to pull away from the fish meat.

METHODS OF USE

Cooking by Boiling

A preferred method for cooking food herein comprises the use of boiling water. This method comprises placing uncooked food, along with desired seasonings or spices, into any embodiment of a bag according to the present invention, releasably sealing the bag so that the bag is air and liquid impermeable when sealed, e.g., by pressing the surface of the composite film in the desired locations to activate the adhesive and create the seal perimeter, placing the sealed bag in a quantity of boiling water sufficient such that the bag is partially submerged in the hot water but remains buoyant (preferably not touching the bottom of the pan in which the water is to be heated) for a time sufficient to cook the food that is placed therein, removing the bag from the water after that time has elapsed, and opening the bag to remove the contents. Preferably the pan in which the hot water is contained is covered during cooking so that the contents in the bag are cooked both from the heat of the water itself and also from the steam that collects inside the covered pan.

Figure 7B:
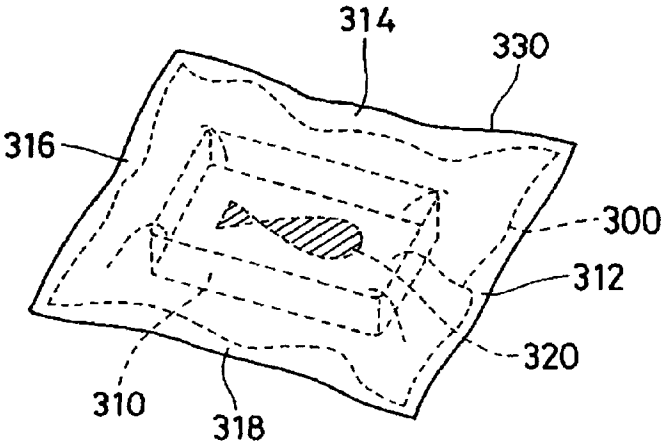
FIGS. 7*a*-7*d* show a preferred method of forming a bag according to the present invention.
Figure 7D:
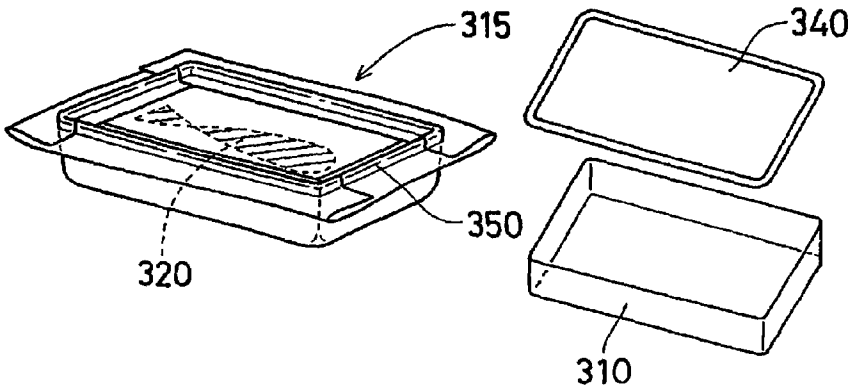
Figure 7A:
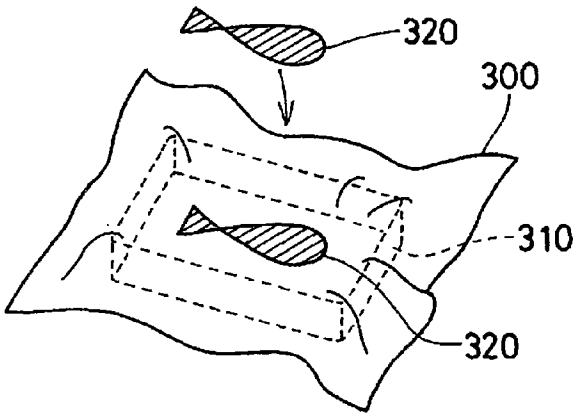

A preferred method of forming a bag of the present invention is shown in FIGS. 7*a*-7*d,* in which the bag is provided with no permanently sealed edges, as previously described herein. Referring to FIG. 7*a,* a first film sheet 300, preferably formed from a composite film material as described herein, is placed atop a container body 310 that has a fifted lid 340, e.g., a TUPPERWARE-type container, with sufficient length of the film extending in all directions past the body of the container. Food and seasonings 320 as desired are placed directly on the first film sheet 300 in the location of the container body interior.

Referring to FIG. 7*b,* a second film sheet 330, also preferably formed from a composite film material as described herein, is superimposed directly over the first film sheet 300 such that four superimposed free edges 312, 314, 316, 318 are created.

Figure 7C:
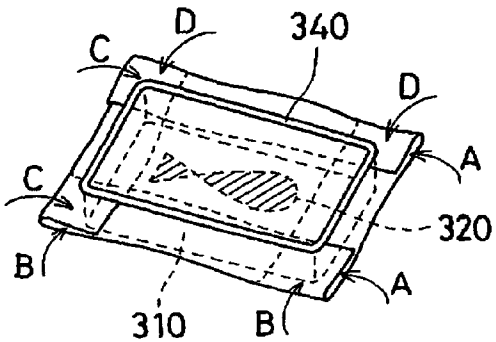

Referring to FIG. 7*c,* all four superimposed free edges 312, 314, 316, 318 are folded over toward the direction of the container body 310 in the direction o the arrows A-D, with folded portions of the superimposed edges remaining outside of the container area. The order of folding is not important. The lid 340 of the container is securely fitted to the body 310 of the container to create the seal perimeter 350 that forms the interior of the bag 315. The lid should be pushed strongly to ensure that the adhesive contained in the composite sheets is fully activated, which ensures an air tight and liquid-tight seal. As shown in FIG. 7*d,* after the seal perimeter 350 is formed, the lid 340 is removed and the bag 315 is taken from the container body 310. The bag 315 is now ready to be placed in the boiling water to cook the contents. After the cooking time has elapsed, the bag is removed from the water, opened, and the contents served.

It should be understood that the sealing step in above-described method need not necessarily be performed by using a container with a fitted lid. The seal perimeter can equally well be created by pressing with the fingers, or with some other type of implement that does not tear the film, at a desired location.

In addition, it should be understood that the above described method for forming the bag by creating the seal perimeter using a container with a fitted lid is not limited to embodiments of the bag that comprise two sheets of film material with no permanently sealed edges. This method can be used to create the seal perimeter for any embodiment of the bag comprising a composite film material that is disclosed herein.

Another preferred method of forming a bag of the present invention comprises placing food and seasonings as desired directly onto a sheet of the composite material described herein. Then, the edges of the film sheet are gathered and tightly twisted together. The twisting action activates the adhesive of the film sheet to create an air and liquid impermeable releasable seal. Cooking can be performed by using boiling water, as above. The sealed bag can be opened by un-twisting the gathered film.

Cooking by Microwave

Another method of cooking herein comprises placing uncooked food into any embodiment of a bag according to the present invention, releasably sealing the bag so that the bag is air and liquid impermeable when sealed, e.g., by pressing the surface of the composite film in the desired locations to activate the adhesive and create the seal perimeter, placing the sealed bag in a microwave oven for a time sufficient to cook the food that has been placed therein, and removing the bag from the microwave oven after that time has elapsed. The bag may then be opened to remove and serve the contents. It is believed that this method is especially useful for steam cooking of raw vegetables such as asparagus, pumpkin, or broccoli. According to such a method, the fresh color and appearance of the vegetable are believed to be well-maintained and superior to conventional methods of cooking by boiling by direct contact in water.

In the methods of cooking by microwave, care should be taken not to introduce oils or oily seasonings into the bag. If such oils are introduced, it is believed that the temperature within the bag may exceed 125° C., thereby comprising the structural integrity of the film material, which may cause the bag to melt.

Preparation of Marinated or Pickled Foods

Yet another method of food preparation herein comprises preparation of marinated or pickled food items. This method comprises placing at least one uncooked food item, e.g., raw vegetables, fish, or meat, and any desired flavorant, e.g., oil, salt, herbs, soy sauce, vinegar, miso, koji (a type of malt), or sakekasu (a rice-based sediment derived from the sake brewing process), into any embodiment of a bag according to the present invention, releasably sealing the bag so that the bag is air and liquid impermeable when sealed, e.g., by pressing the surface of the composite film in the desired locations to activate the adhesive and create the seal perimeter at the desired seal perimeter, placing the sealed bag in the refrigerator and leaving the bag in the refrigerator for a time sufficient to flavor the food. In most cases 1-2 nights is believed to be sufficient. The bag may then be opened to remove and serve the contents.

In the case of uncooked vegetables, the flavored vegetables may be eaten as is after removal from the bag. Such vegetables may be referred to by their Japanese name, "tsukemono." In the case of marinated fish or meat, the marinated fish or meat must be subsequently be cooked, e.g., by grilling or boiling as described above.

Reheating

In addition to the methods of preparation for uncooked foods above, the bags of the present invention may be used to reheat foods that have already been cooked. The boiling methods described above are preferred for reheating, as foods containing oils may cause the bag to become too hot if placed in a microwave oven.

In the reheating methods herein, water temperatures of less than 100° C. (boiling) may be used, as the higher level of heat generated by boiling water may not be needed in cases where the food is not raw or uncooked and there is no danger of eating undercooked foods. Depending on the type of food item to be reheated and the user's preference as to how warm this food item should be, temperatures of from about 50° C. to about 100° C. are suitable. As a non-limiting example, it may be desired to warm a dessert cake that has been stored in the refrigerator prior to eating.

However, it bears repeating that for raw or uncooked foods, boiling at 100° C. is preferred to avoid any problems or sickness that could arise as a result of eating undercooked foods.

It is understood that the examples and embodiments described herein are for illustrative purposes only and that various modifications or changes in light thereof will be suggested to one of skill in the art without departing from the scope of the present invention.

What is claimed is:

1. A method for low temperature cooking comprising the steps of:

(a) forming a bag comprising a first homogeneous film material and a pressure sensitive adhesive disposed upon said film, said adhesive being protected from inadvertent adherence, wherein the film material does not deform at temperatures of up to about 125° C. a second homogeneous film material, said film materials being superimposed and having superimposed edges, at least a portion of said superimposed edges being permanently sealed, wherein said second film material is provided with a pressure sensitive adhesive protected from inadvertent adherence, the second film material being releasably sealable to said first film material when pressed thereagainst to create a seal perimeter, wherein an interior of the bag is comprised within the seal perimeter and wherein the bag is air and liquid impermeable when sealed by placing the first sheet of film material atop a body of a container that has a fitted lid with sufficient length of the film extending in all directions past the body of the container;

(b) placing at least one food item to be cooked directly on the first film sheet in the location of the container body;

(c) superimposing the second film sheet directly over the first film sheet such that the superimposed free edges are created;

(d) creating the seal perimeter by fitting the lid of the container to the body of the container wherein the pressure-sensitive adhesive is activated, the at least one food item being located in the interior of the bag;

(e) placing the sealed bag in an amount of boiling water sufficient to partially submerge the bag;

(f) leaving the bag in the water for a period of time sufficient to cook the food item that was placed in the bag; and (g) removing the bag from the water.

2. A method for low temperature cooking comprising the steps of:

(a) a bag comprising a first homogeneous film material and a pressure sensitive adhesive disposed upon said film, said adhesive being protected from inadvertent adherence, wherein the film material does not deform at temperatures of up to about 125° C. wherein said film material further comprises a first portion with at least one first portion free edge, a second portion with at least one second portion free edge, and a juncture area between the first portion and the second portion, wherein at least one of the first portion or the second portion further comprises a pressure sensitive adhesive protected from inadvertent adherence, and wherein the first portion is overlaid onto the second portion by folding about the juncture area, the first and second portions being releasably sealable to each other along a seal perimeter created by pressing one of the portions against the other of the portions, wherein an interior of the bag is comprised within the seal perimeter, and wherein the bag is air and liquid impermeable when sealed, by placing the first portion of the sheet of film material atop a body of a container that has a fitted lid with sufficient length of the film extending in all directions past the body of the container;

(b) placing at least one food item to be cooked directly on the first portion in the location of the container body;

(c) superimposing the second portion of the film sheet directly over the first portion such that the superimposed free edges are created;

(d) creating the seal perimeter by fitting the lid of the container to the body of the container wherein the pressure-sensitive adhesive is activated, the at least one food item being located in the interior of the bag;

(e) placing the sealed bag in an amount of boiling water sufficient to partially submerge the bag;

(f) leaving the bag in the water for a period of time sufficient to cook the food item that was placed in the bag; and (g) removing the bag from the water.

3. A method for low temperature cooking comprising the steps of:

(a) a bag comprising a first homogeneous film material and a pressure sensitive adhesive disposed upon said film, said adhesive being protected from inadvertent adherence, wherein the film material does not deform at temperatures of up to about 125° C. a second film material, wherein said second film material is a composite film material provided with a pressure sensitive adhesive protected from inadvertent adherence, said second film material being releasably sealable to said first film material and forming an interior of the bag when pressed there against to form a seal perimeter, wherein an interior of the bag is comprised within the seal perimeter, and wherein the bag is air and liquid impermeable when sealed by placing the first sheet of film material atop a body of a container that has a fitted lid with sufficient length of the film extending in all directions past the body of the container;

(b) placing at least one food item to be cooked directly on your first film sheet in the location of the container body;

(c) superimposing the second film sheet directly over the first film sheet such that the superimposed free edges are created;

(d) creating the seal perimeter by fitting the lid of the container to the body of the container wherein the pressure-sensitive adhesive is activated, the at least one food item being located in the interior of the bag;

(e) placing the sealed bag in an amount of boiling water sufficient to partially submerge the bag, (f) leaving the bag in the water for a period of time sufficient to cook the food item that was placed in the bag; and (g) removing the bag from the water.

4. A method for low temperature cooking comprising the steps of:

(a) a bag comprising a first homogeneous film material and a pressure sensitive adhesive disposed upon said film, said adhesive being protected from inadvertent adherence, wherein the film material does not deform at temperatures of up to about 125° C. wherein said film material further comprises a first portion with at least one first portion free edge, a second portion with at least one second portion free edge, and a juncture area between the first portion and the second portion, wherein at least one of the first portion or the second portion comprises a pressure sensitive adhesive protected from inadvertent adherence, wherein at least one of the first or second portion free edges is provided with an opening indication means that visually contrasts with the other first or second portion free edges, and wherein the first portion is overlaid onto the second portion by folding about the juncture area, the first and second portions being releasably sealable to each other along a seal perimeter created by pressing one of the portions against the other of the portions, and the seal perimeter further comprising the juncture area, and wherein the bag is air and liquid impermeable when sealed by placing the first sheet of film material atop a body of a container that has a fitted lid with sufficient length of the film extending in all directions past the body of the container;

(b) placing at least one food item to be cooked directly on your first film sheet in the location of the container body;

(c) superimposing the second film sheet directly over the first film sheet such that the superimposed free edges are created;

(d) creating the seal perimeter by fitting the lid of the container to the body of the container wherein the pressure-sensitive adhesive is activated, the at least one food item being located in the interior of the bag;

(e) placing the sealed bag in an amount of boiling water sufficient to partially submerge the bag, (f) leaving the bag in the water for a period of time sufficient to cook the food item that was placed in the bag; and (g) removing the bag from the water.

* * * * *